US010894693B2

(12) United States Patent
Newgent et al.

(10) Patent No.: US 10,894,693 B2
(45) Date of Patent: Jan. 19, 2021

(54) COUNTER ASSEMBLY

(71) Applicants: James Newgent, Magnolia, TX (US); Tammy Newgent, Magnolia, TX (US)

(72) Inventors: James Newgent, Magnolia, TX (US); Tammy Newgent, Magnolia, TX (US)

( * ) Notice: Subject to any disclaimer, the term of this patent is extended or adjusted under 35 U.S.C. 154(b) by 55 days.

(21) Appl. No.: 16/016,277

(22) Filed: Jun. 22, 2018

(65) Prior Publication Data

US 2019/0389686 A1 Dec. 26, 2019

(51) Int. Cl.
*B65H 59/06* (2006.01)
*B65H 61/00* (2006.01)

(52) U.S. Cl.
CPC ..... *B65H 59/06* (2013.01); *B65H 61/00* (2013.01)

(58) Field of Classification Search
CPC ..... B65H 59/06; B65H 61/00
See application file for complete search history.

(56) References Cited

U.S. PATENT DOCUMENTS 3,825,197 A * 7/1974 Sturgeon ..... B65H 54/2812 242/419.5
4,089,451 A * 5/1978 Zlaikha ..... B65H 20/04 226/136
4,099,484 A * 7/1978 Ohno ..... G03G 15/2092 100/168
6,811,112 B1 * 11/2004 Currie ..... B65H 54/2872 242/157.1
2005/0116079 A1 * 6/2005 Stevens ..... B60D 1/185 242/419.5

* cited by examiner

*Primary Examiner* — Sang K Kim
(74) *Attorney, Agent, or Firm* — Law Office of Jeff Williams PLLC; J. Oliver Williams

(57) ABSTRACT

A counter assembly for use with coiling machinery for the measurement of line being wound or unwound on a reel includes a body, an upper arm, a lower arm, and a tensioner assembly. The body defines a central channel for passage of the line. Rollers are coupled to the upper and lower arms and used to press against the line. Movement of the line between the rollers causes at least one roller to rotate. Rotation is converted to a linear distance for accurate measurement. The upper arm has a pivot axis that is below a horizontal portion of the upper arm and is shared with the lower arm. The tensioner assembly is oriented to share the same vector components of motion as the pivoting upper arm. The tensioner assembly also permits adjustment in the resting spring force acting on the rollers.

19 Claims, 5 Drawing Sheets

COUNTER ASSEMBLY

BACKGROUND

1. Field of the Invention

The present application relates to coiling machinery for the winding and unwinding of coil reels, and more particularly to a counter assembly for measuring the amount of line that is unwound or wound on the reel.

2. Description of Related Art

Metallic cables and wires are used in many types of applications within industry. These cables are stored typically on a reel or spool because these cables and wires are very long and the act of wrapping them around a cylindrical spool is a fairly efficient way to store, transport, and use them without concern for bending or creasing the cables. Coiling machinery is used to assist in the winding and unwinding of these spools of cable. Depending on the size of the cable and spool, these spools can be extremely heavy. The coiling machinery therefore has to be built to be very sturdy and stable. This machinery typically includes a means of elevating the spool off the floor and a means of counting the amount of cable unwound or wound. Spools rotate about a shaft. As these spools can be very large, the counter can slide on a track across the width of the coil machine. The purpose of the counter is to measure the length of line either wound onto the reel or unwound from the reel, depending on the direction of winding.

A disadvantage of these coil machines lie with the counters used. The counter assembly typically operates by passing the line between two opposing rollers. At least one of the rollers grips the line and is monitored to detect the amount of rotations made. This rotation is converted into a linear measurement by knowing the size of the roller. As long as the rollers are in contact with the line, the assembly provides an accurate count. Additionally, as long as the rollers have sufficient force applied to them to facilitate gripping of the line, the assembly provides an accurate count.

Typically each roller is coupled to a distinct arm. These arms are on separate planes from each other. The upper arm is configured to pivot about an axis that is located on a side opposite the lower arm. Rotation of the upper arm then provides a rotational vector movement immediately forward and upward. The problem arises with the orientation of springs used to combat undesired separation of the rollers. The springs are oriented rearward from the lower arm to the upper arm, so as to be oriented toward the axis. Orientation of the springs rearward toward the axis of the upper arm results in the spring tension in having moving vector components that are rearward and upward. The horizontal vector components of the upper arm and the spring (to remain in tension) are opposite one another. As the upper arm is below the axis, the immediate forward vector of the upper arm is opposite that of the rearward vector of the tension in the spring. The pivoting of the upper arm actually induces a shortening of the spring (less tension force) and not an increased tension force. This causes the upper arm to bounce at times with minimal jerking. The bouncing prevents accurate measurement.

Springs are relied upon to stop bouncing and to maintain continuous contact between the rollers and the line. These springs produce a constant and unadjustable tension spring force pulling the arms back together. Although springs are useful to an extent, their use is also prohibitive. The spring force of one set of springs is not sufficient for the use on all types of line/cable/wire. As each line has a different diameter, and is made from a different material(s) of varied harness, the spring forces from a set of springs can hinder the versatility of the counter assembly.

Although strides have been made to provide a reliable means of counting the linear feet of line off or onto a reel, shortcomings remain. It is desired that a new counter assembly be provided that minimizes bouncing effects and allows for adjustment of the spring force between arms.

SUMMARY OF THE INVENTION

It is an object of the present application to provide a counter assembly for use with coiling machinery for the measurement of line being wound or unwound on a reel. The counter assembly includes a body for locating one or more rollers. The rollers are adjustable relative to one another to permit passage of the line there between. Movement of the line between the rollers causes at least one roller to rotate. Rotation is converted to a linear distance for accurate measurement. The counter assembly is configured to minimize inaccuracies in measurement and provide a method of increasing versatility of the counter assembly with multiple sizes and materials of line.

It is a further object of the present application that the arms of the counter assembly be in communication with one another. The arms are configured to share a pivot axis. The axis is located below the upper arm. The upper arm pivots relative to the lower arm and that induces movement that is rearward and upward.

Another object of the present application is to orient the springs and tensioner assembly relative to the upper pivoting arm in a manner that minimizes bouncing of the arms. By using a common or shared axis between the arms, the shared axis is below the upper arm. Therefore, rotation of the upper arm is in a vector oriented immediately upward and rearward to the axis. The springs and tensioner assembly are oriented in the same upward and rearward directions as the arm rotation. Movement of the arm produces immediate tensioning of the spring. No pivoting or immediate slack response is provided.

It is another object of the present application that the resting spring force between the arms is configured to be adjustable. The counter assembly includes at least one spring and a tensioner assembly coupled to one end of the spring. The tensioner assembly is also coupled to an arm. Operation of the tensioner assembly acts to lengthen or shorten an elongated spring, thereby increasing or decreasing the spring force being exerted between the arms.

Ultimately the invention may take many embodiments. This assembly overcomes the disadvantages inherent in the prior art.

The more important features of the assembly have thus been outlined in order that the more detailed description that follows may be better understood and to ensure that the present contribution to the art is appreciated. Additional features of the assembly will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the assembly in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and assemblies for carrying out the various purposes of the present assembly. It is important, therefore, that the claims be regarded as including such equivalent constructions insofar as they do not depart from the spirit and scope of the present assembly.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
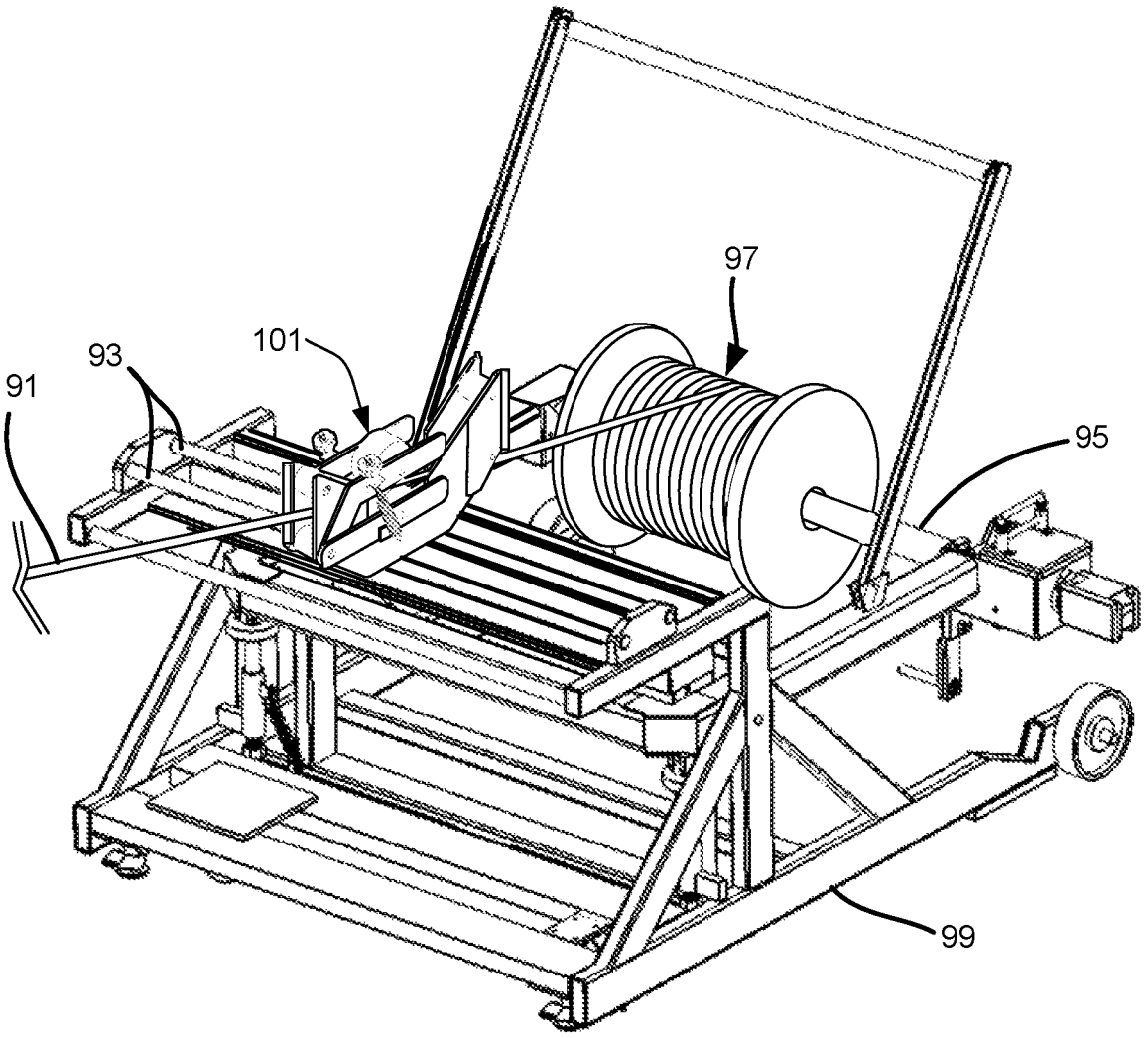
FIG. 1 is a perspective view of a counter assembly according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with assembly-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with conventional counter assemblies discussed previously. In particular, the counter assembly is configured to minimize bounce that results in unexpected or discontinuous amounts of resistance experienced in the line. Additionally, the counter assembly is configured to provide means for adjusting the resting tension force between the rollers. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a body for locating one or more rollers. The rollers are adjustable relative to one another to permit passage of the line there between. Movement of the line between the rollers causes at least one roller to rotate. Rotation is converted to a linear distance for accurate measurement. Also included is a tensioner assembly that permits adjustment of the resting tension force on the rollers. Additional features and functions of the assembly are illustrated and discussed below.

Referring now to the Figures wherein like reference characters identify corresponding or similar elements in form and function throughout the several views. The following Figures describe the assembly of the present application and its associated features. With reference now to the Figures, an embodiment of the counting assembly and method of use are herein described. It should be noted that the articles "a", "an", and "the", as used in this specification, include plural referents unless the content clearly dictates otherwise.

Referring now to FIG. 1 in the drawings, a perspective view of a counting assembly 101 is illustrated. Assembly 101 is configured to measure the amount of line that is removed from a reel, or the amount of line that is wound up onto a reel. The line can be a cable, one or more wires, and may have various thicknesses. Additionally, the line may be of any hardness. Assembly 101 is configured to be used with different lines as each reel can have a different line on it. As seen in FIG. 1, assembly 101 is located on a coiling machine that has a frame 99 that is used to support the elevating of reel 97 above the floor to permit free rotation. Reel 97 rotates about a bar 95. Counter assembly 101 translates side to side on a track 93. Movement along track 93 occurs as the location of line 91 varies across reel 97. As line 91 passes through assembly 101, a counter tracks or converts the rotational movement of the roller into a linear measurement. The counter is not illustrated, as nor is the mounting device used to couple assembly 101 to track 93, in the interest of clarity. It is understood that other types of coiling machines are in existence. Each machine may be of different size, but the function is fairly consistent. It is also understood that assembly 101 may be used with both mechanical and electronic counter devices.

Figure 2:
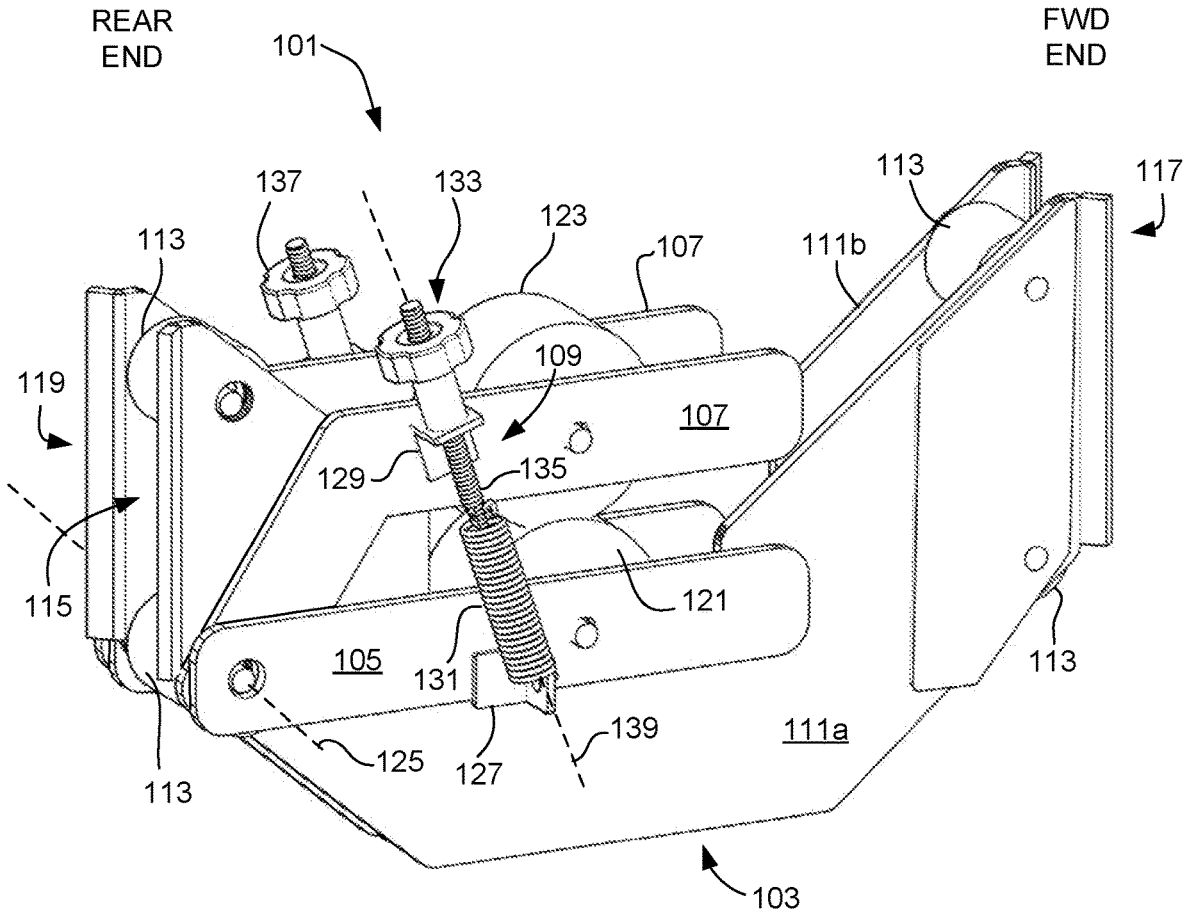
FIG. 2 is an enlarged rear perspective view of the counter assembly of FIG. 1.
Figure 3:
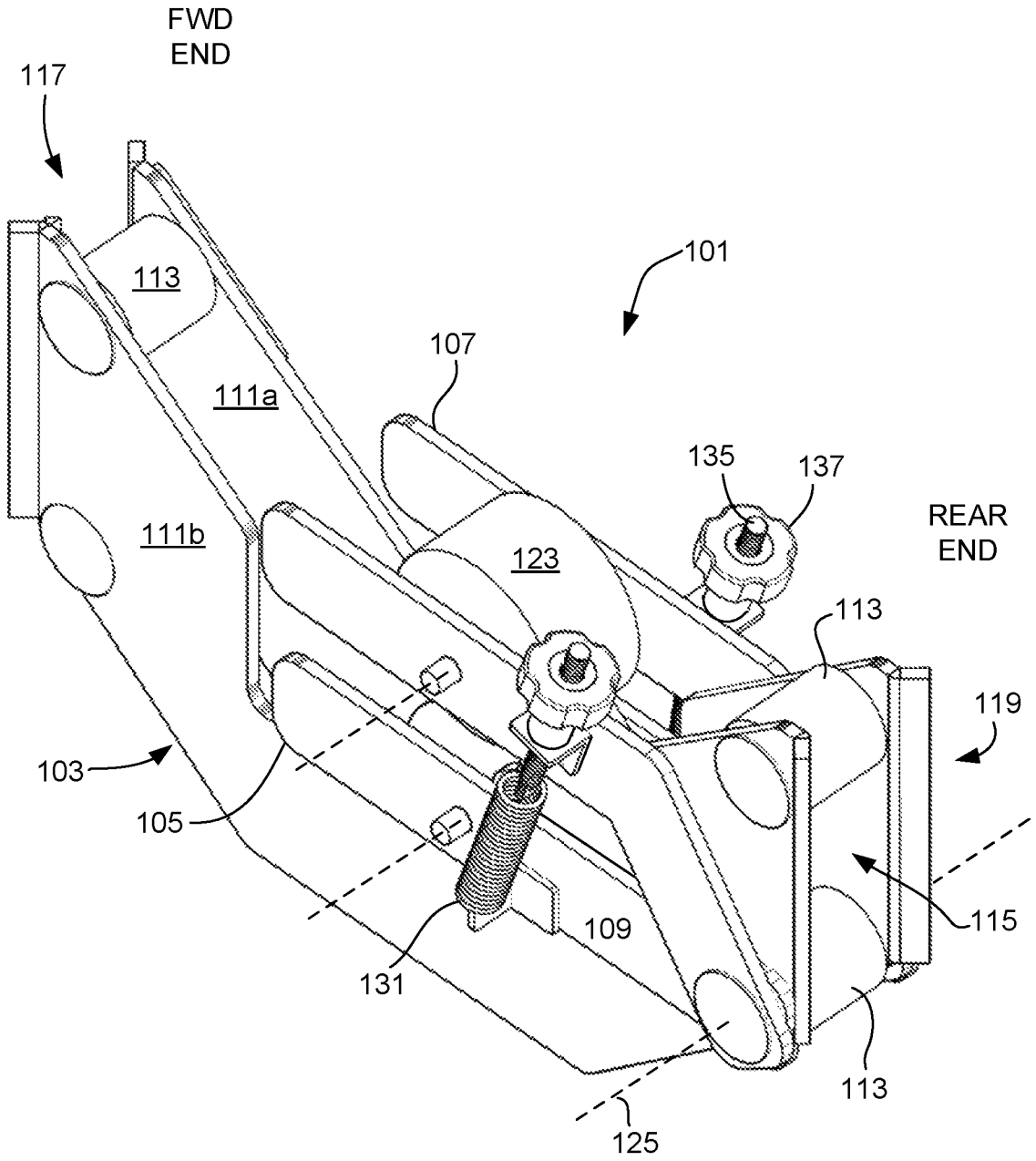
FIG. 3 is an alternate rear perspective view of the counter assembly of FIG. 2.
Figure 4:
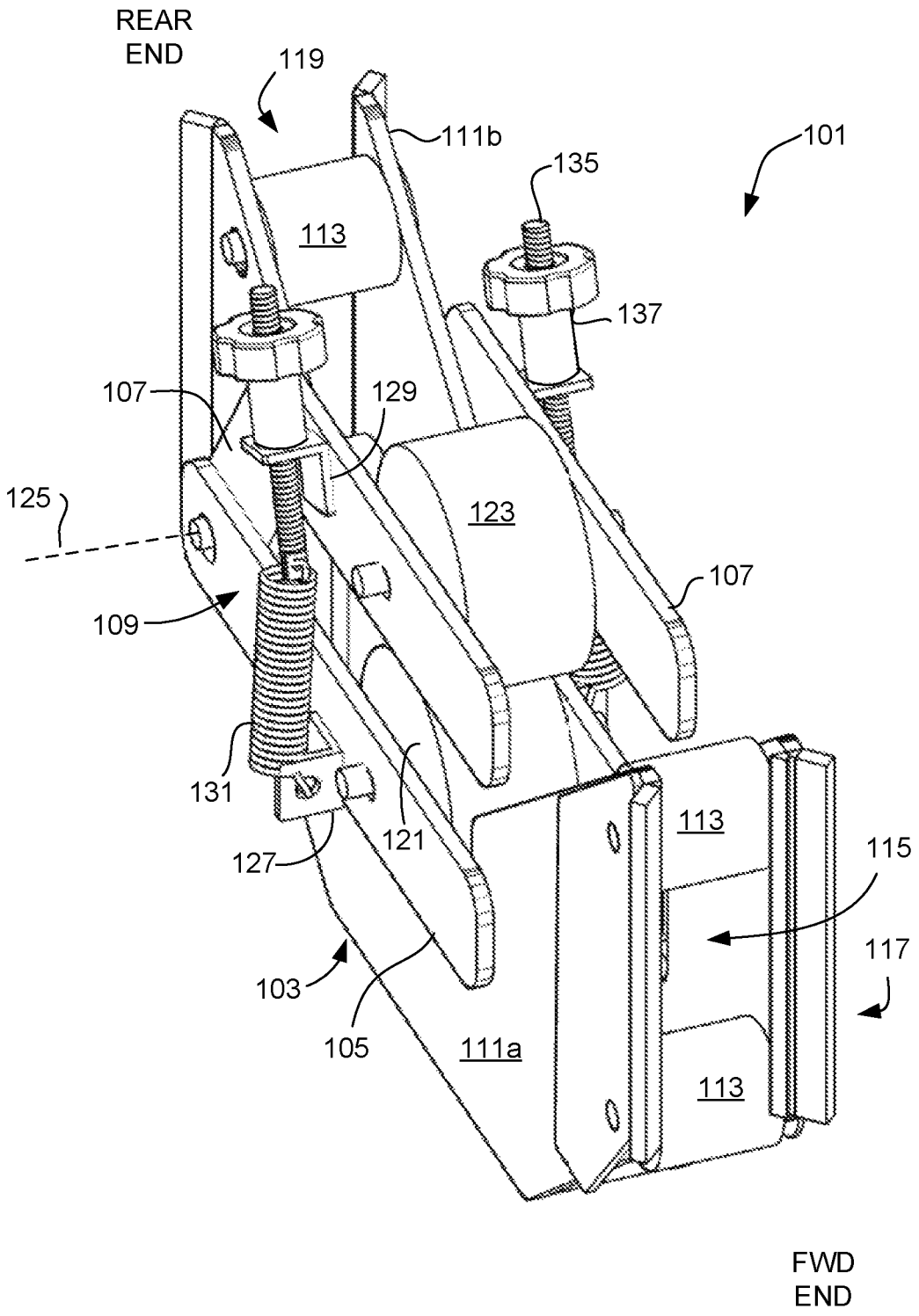
FIG. 4 is a front perspective view of the counter assembly of FIG. 2.

Referring now also to FIGS. 2-4 in the drawings, assembly 101 is illustrated in various forward and rear perspective views. Assembly 101 includes a body 103, a lower arm 105, an upper arm 107, and a tensioner assembly 109. Body 103 includes opposing side panels 111*a*/111*b* that are separated from each other through the use of one or more spacers 113. Side panels 111*a*/111*b* are parallel to each other and define a channel 115 or space there through for passage of line 91. Channel 115 extends from a front opening 117 to a rear opening 119 of body 103. Front opening 117 is at the forward end of assembly 101 and rear opening 119 is at the rear end of assembly 101.

A plurality of arms are included within assembly 101 and are configured to locate a first roller 121 and a second roller 123 within channel 115. These rollers 121/123 are configured to contact upper and lower surfaces of line 91 that pass through channel 115. When line 91 is not within channel 115, rollers 121 and 123 are configured to contact one another. This defines the resting position of upper arm 107, wherein second roller 123 of upper arm 107 is in contact with first roller 121 of lower arm 105 (as seen in the Figures). Rollers 121/123 are configured to rotate about an axis of rotation that is perpendicular to panels 111*a*/111*b*. As line 91 is fed through channel 115 and rollers 121/123, the rollers spin about their axis of rotation. This rotation is used to determine linear distance of line 91. It is understood that other embodiments may include electronics that in fact measure the line directly as it passes through channel 115. Even in these embodiments, rollers 121/123 are needed and are configured to rotate about their axes.

Lower arm 105 is coupled to panel 111*a* and runs along an outer face thereof. The axis of rotation of roller 121 passes through lower arm 105. A lower arm is located on either side of body 103, therefore a second lower arm is in communication with panel 111*b*. The two lower arms 105 may or may not be in direct communication with each other. The same holds true for upper arm 107. An upper arm is located in communication with body 103. One is associated with panel 111*a* and the other is associated with panel 111*b*. For purposes of discussion, only a singular arm 105/107 will be discussed as such attributes of one will apply equally to the other in kind.

Upper arm 107 is configured to have a horizontal portion in communication with roller 123 and an angled portion that is sloped downward to lower member 105. The horizontal portion of upper arm 107 is parallel to that of lower arm 105. The sloped portion of upper arm 107 is coupled to body 103 and lower arm 105. Upper arm 107 is configured to pivot about a pivot axis 125. Pivot axis 125 is shared with and passes through lower arm 105. Both upper arm 107 and lower arm 105 pivot about axis 125. It is understood that lower arm 105 may be rigidly affixed in position relative to body 103 such that no movement or rotation is permissible, however, in such situations upper arm 107 is permitted to rotate about axis 125. Sloped portion of upper arm 107 is coupled to lower arm 105. Of note is that rollers 121/123 rotate with their respective arm 105/107 respectively. Upper arm 107 may pivot independent of lower arm 105.

Tensioner assembly 109 extends between lower arm 105 and upper arm 107. Tensioner assembly 109 is configured to resist separation of first roller 121 from second roller 123. In other words, tensioner assembly 109 is configured to maintain contact between rollers 121/123 when line 91 is not in channel 115 or to maintain rollers 121/123 in contact with line 91 when line 91 is in channel 115. Tensioner assembly 109 is oriented between a lower location 127 and an upper location 129. Upper location 129 is coupled to upper arm 107, in particular with the horizontal portion of upper arm 107. Lower location 127 is coupled to lower arm 105. Lower location 127 is further forward of upper location 129, such that the length of tensioner assembly 109 is pointed further rearward at upper arm 107. Axis 125 is adjacent the rear end of body 103 and is further rearward than upper location 129. Additionally, axis 125 is below upper location 129.

Tensioner assembly 109 includes a spring 131 and a tension device 133. Spring 131 is coupled to lower location 127 and extends upward and rearward to a lower portion of tension device 133. Spring 131 is not in contact directly with upper arm 105. Tension device 133 is coupled to upper location 129 and extends downward and forward to spring 131. Tension device 133 includes a threaded rod 135 in which spring 131 is coupled to the lower end. A handle 137 is provided within tension device 133 that surrounds the threaded rod 135, such that when rotated, threaded rod 135 translates either upward or downward therein, so as to either extend or retract the length of spring 131. Adjustment of threaded rod 135 within handle 137 adjusts a resting spring force exerted by spring 131 on rollers 121/123. Adjustment can increase and decrease the resting spring force. It is understood that spring 131 defines a spring axis 139. Spring axis 139 is configured to point away from axis 125, or to be pointed in the tangential direction of motion for upper arm 107.

Figure 5:
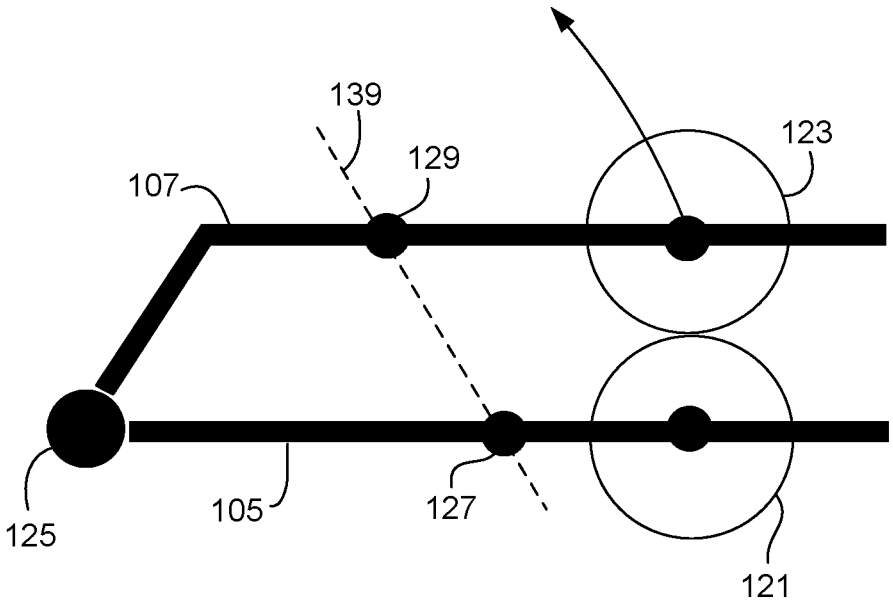
FIGS. 5 and 6 are schematics of the counter assembly of FIG. 2 from the side.
Figure 6:
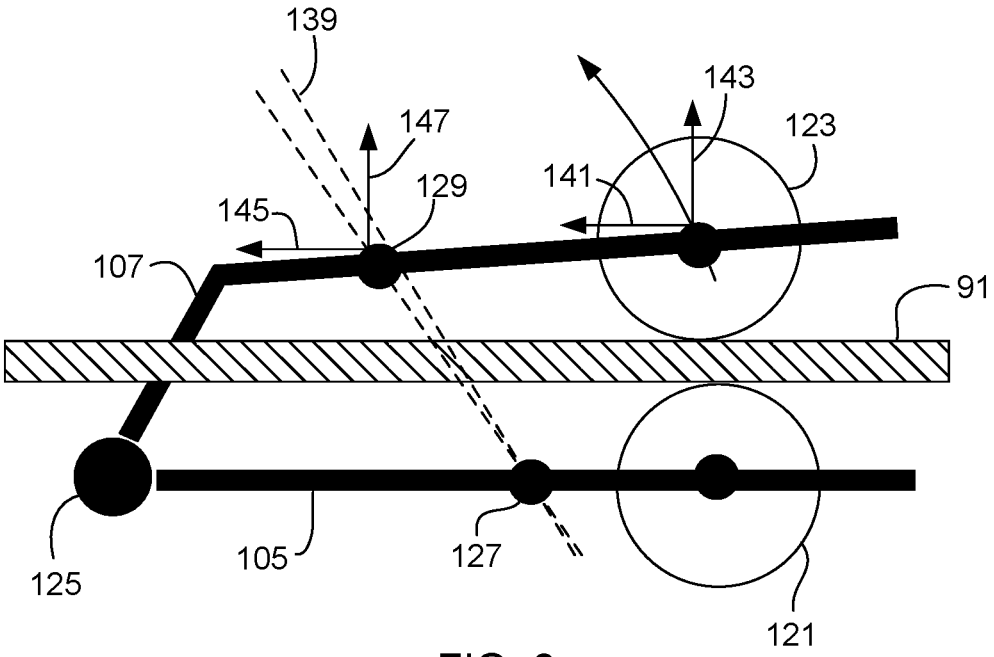

Referring now also to FIGS. 5 and 6 in the drawings, two schematics showing a side view of assembly 101 is illustrated. As noted previously, upper arm 107 is configured to pivot about axis 125 such that rotation of upper arm 107 creates a gap between roller 123 and roller 121. FIG. 5 shows upper arm 107 at a resting state. In this embodiment, the horizontal portion of upper arm 107 is horizontal and parallel to that of lower arm 105. Axis 125 is depicted in FIGS. 5 and 6 and represents the point of rotation for upper arm 107. In FIG. 6, upper arm 107 is rotated about axis 125 and wire 91 is inserted there through. Tensioner assembly 109 is depicted with lower location 127 and upper location 129 shown on their respective arms 105/107.

From these views, the motion of upper arm 107 is more clearly shown. Due to axis 125 being below and rearward of both upper location 129 and the axis of rotation of roller 123, rotation about axis 125 yields radial movement that can be divided into vector components. Upper arm 107 has a horizontal vector component 141 and a vertical vector component 143. Upper location 129 has a horizontal vector component 145 and a vertical vector component 147. Spring axis 139 is aligned to orient tensioner assembly 109 to have the same tangential vector movement as that of upper arm 107. As seen in FIG. 6, both upper arm 107 and upper location 129 continuously have horizontal vector components in the same direction and vertical vector components in the same direction. During motion of upper arm 107, spring axis 139 rotates about lower location 127. Rotational motion of upper arm 107 maintains tension in spring 131 when opening to accept wire 91. By maintaining tension during rotation of upper arm 107, bounce is greatly minimized as there is no point at which the vector components are opposite one another.

The current application has many advantages over the prior art including at least the following: (1) minimized bounce by matching the horizontal and vertical vector components of the tensioner assembly and upper arm; (2) the axis of the upper arm being located below and rearward of the tensioner assembly; (3) the ability to adjust the tension in the spring to conform the material characteristics of the line.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A counter assembly, comprising:

a body having opposing side panels separated from each other, the body defining a channel between the opposing side panels extending from a front opening to a rear opening;

a lower arm in communication with the body, the lower arm including a first roller passing within the channel of the body;

an upper arm in communication with the body, the upper arm including a second roller passing within the channel of the body, the upper arm and the lower arm pivoting about a single axis shared with the upper and lower arms, the single axis being below the second roller and planar with the lower arm; and a tensioner assembly coupling the lower arm to the upper arm, the tensioner assembly configured to resist separation of the first roller and the second roller, the tensioner assembly being oriented rearward at the upper arm such that the tensioner assembly is closer to the first roller than the second roller.

2. The assembly of claim 1, wherein the lower arm and the upper arm are coupled together.

3. The assembly of claim 1, wherein the upper arm pivots independent of the lower arm.

4. The assembly of claim 1, wherein the tensioner assembly is oriented between an upper location and a lower location, the lower location being on the lower arm and the upper location being on the upper arm.

5. The assembly of claim 4, wherein the tensioner assembly defines a spring axis, the spring axis pointing away from the single axis.

6. The assembly of claim 1, wherein the tensioner assembly includes a spring and a tension device.

7. The assembly of claim 6, wherein the spring extends between the tension device and at least one of the lower arm and the upper arm.

8. The assembly of claim 6, wherein the tension device is configured to either extend or retract the length of the spring thereby adjusting a resting spring force of the spring.

9. The assembly of claim 1, wherein movement of the upper arm and the tensioner assembly are split into vector components, the vector components being composed of a vertical component and a horizontal component, the horizontal component of the upper arm and the tensioner assembly are continuously in the same direction.

10. The assembly of claim 9, wherein vertical components of the vector components are in the same direction.

11. The assembly of claim 1, wherein the spring is oriented to such that rotation of the upper arm away from a resting position only increases tension in the spring.

12. A counter assembly, comprising:

a body having opposing side panels separated from each other, the body defining a channel between the opposing side panels extending from a front opening to a rear opening;

a lower arm in communication with the body, the lower arm including a first roller passing within the channel of the body;

an upper arm in communication with the body, the upper arm including a second roller passing within the channel of the body, a single axis being below the second roller and planar with the lower arm; and a tensioner assembly coupling the lower arm to the upper arm, the tensioner assembly includes a spring and a tension device, the spring extends between the tension device and at least one of the lower arm and the upper arm, the tension device configured to adjust tension in the spring, the tensioner assembly configured to resist separation of the first roller and the second roller, the spring being oriented rearward at the upper arm such that the spring is closer to the first roller than the second roller.

13. The assembly of claim 12, wherein the tension device is configured to either extend or retract the length of the spring thereby adjusting a resting spring force of the spring.

14. The assembly of claim 12, wherein movement of the upper arm and the tensioner assembly are split into vector components, the vector components being composed of a vertical component and a horizontal component, the horizontal component of the upper arm and the tensioner assembly are continuously in the same direction.

15. The assembly of claim 14, wherein vertical components of the vector components are in the same direction.

16. The assembly of claim 12, wherein the spring is oriented to such that rotation of the upper arm away from a resting position only increases tension in the spring.

17. The assembly of claim 12, wherein the tensioner assembly is oriented between an upper location and a lower location, the lower location being on the lower arm and the upper location being on the upper arm.

18. The assembly of claim 17, wherein the tensioner assembly defines a spring axis, the spring axis is aligned with the direction or rotation of the upper arm.

19. The assembly of claim 12, wherein the lower arm and the upper arm are coupled together about a single axis.

* * * * *